US008220661B2

(12) United States Patent
Ng et al.

(10) Patent No.: US 8,220,661 B2
(45) Date of Patent: Jul. 17, 2012

(54) APPARATUS FOR DISPENSING MEASURED QUANTITIES OF LIQUID

(75) Inventors: Hon Yu Peter Ng, Hong Kong (CN); Dazhang Liao, Hong Kong (CN); Wing Fung Jacob Cheung, Hong Kong (CN); Ping Kong Choy, Hong Kong (CN); King Sang Tsui, Hong Kong (CN)

(73) Assignee: ASM Assembly Automation Ltd, Hong Kong (HK)

( * ) Notice: Subject to any disclaimer, the term of this patent is extended or adjusted under 35 U.S.C. 154(b) by 1017 days.

(21) Appl. No.: 12/185,391

(22) Filed: Aug. 4, 2008

(65) Prior Publication Data

US 2010/0025428 A1 Feb. 4, 2010

(51) Int. Cl.
*B67D 1/00* (2006.01)
*B65D 83/00* (2006.01)
*B65D 5/72* (2006.01)

(52) U.S. Cl. ..... 222/61; 222/55; 222/397; 222/571

(58) Field of Classification Search ..... 222/61, 222/394, 55, 396, 397, 571, 152
See application file for complete search history.

(56) References Cited

U.S. PATENT DOCUMENTS

| | | | | |
|---|---|---|---|---|
| 4,989,756 | A * | 2/1991 | Kagamihara et al. | 222/55 |
| 5,199,607 | A * | 4/1993 | Shimano | 222/55 |
| 5,277,333 | A | 1/1994 | Shimano | |
| 7,527,768 | B2 * | 5/2009 | Ikushima | 422/502 |
| 7,748,342 | B2 * | 7/2010 | Son et al. | 118/300 |

* cited by examiner

*Primary Examiner* — Kevin P Shaver
*Assistant Examiner* — Stephanie E Williams
(74) *Attorney, Agent, or Firm* — Ostrolenk Faber LLP

(57) ABSTRACT

A liquid dispensing apparatus is provided which has a syringe for storing and dispensing a liquid, and a connector passage connected to the syringe. A positive pressure passage is connected to an air source for supplying positive pressure to the syringe, and there is a pressure valve located along the positive pressure passage that is operative to control the flow of air along the positive pressure passage. A vacuum passage is connected to a vacuum generator for supplying vacuum pressure to the syringe, and there is a vacuum valve located along the vacuum passage that is operative to control the flow of air along the vacuum passage. The positive pressure passage and vacuum passage are connected to the connector passage. A pressure sensor is also provided to measure the pressure in the connector passage.

18 Claims, 1 Drawing Sheet

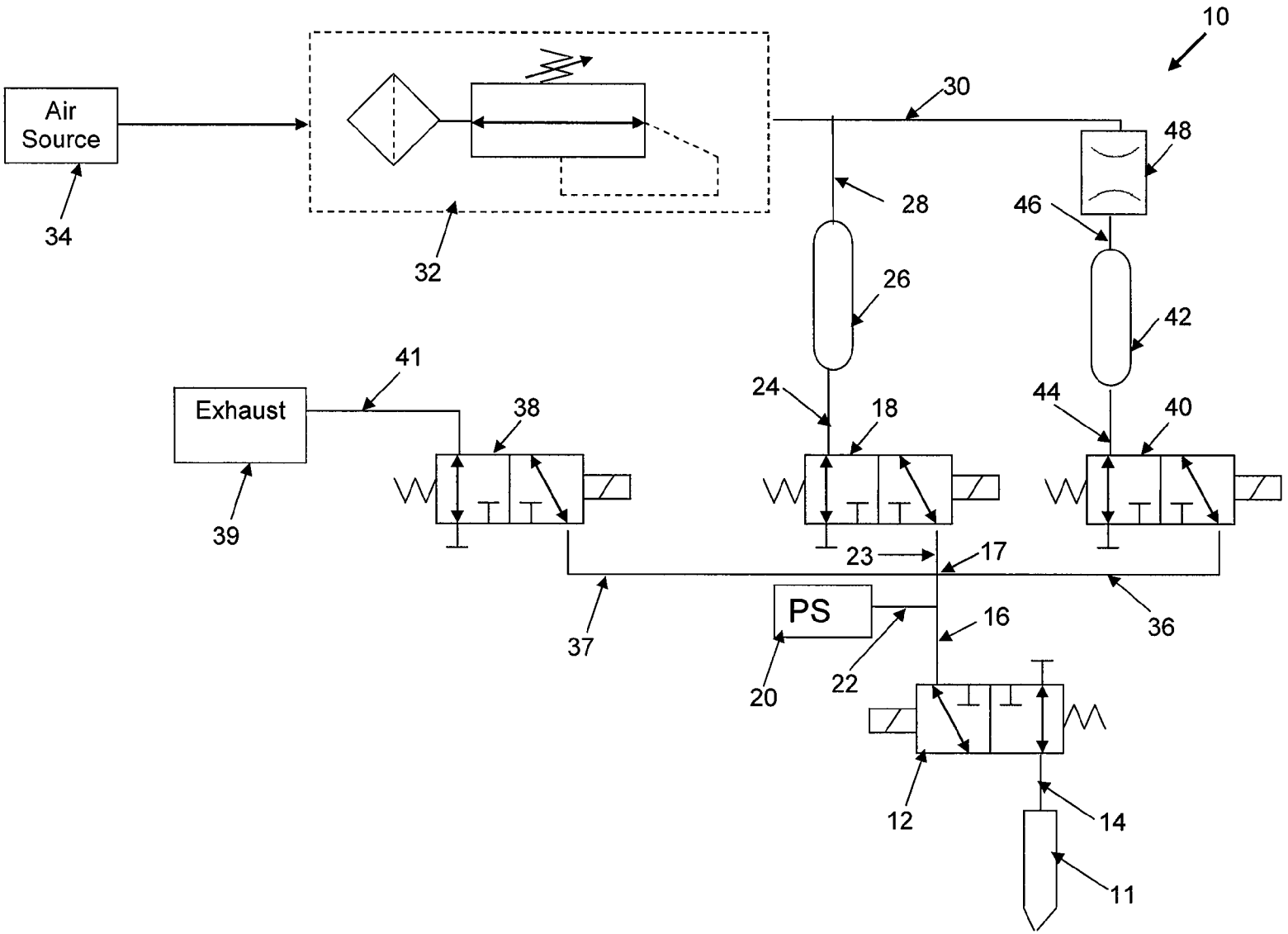
10
48
42
40
36
46
44
14
11
30
28
26
18
17
16
12
23
22
PS
20
24
32
37
38
41
Exhaust
39
Air Source
34

APPARATUS FOR DISPENSING MEASURED QUANTITIES OF LIQUID

FIELD OF THE INVENTION

The invention relates to dispensing apparatus, and in particular to a liquid dispenser for accurately metering and discharging a predetermined quantity of viscous or paste-like liquid such as epoxy used in packaging electronic devices.

BACKGROUND AND PRIOR ART

A time-pressure liquid dispenser usually delivers pressurized air to dispense a required amount of liquid from a syringe. Proper control of the dispensing duration and dispensing pressure determine the dispensing performance, such as the volume consistency of the fluid dispensed. Typically, measurement of dispensing pressure is used as a means for adjusting the dispensing time to dispense a predetermined amount of liquid. The time-pressure liquid dispenser generally comprises a syringe containing a liquid for dispensing, an air source for supplying air under positive pressure and a dispensing solenoid valve located between the syringe and the air source. Conventionally, two pressure sensors are used for monitoring pressure in the liquid dispenser. A first pressure sensor measures a syringe pressure and a second pressure sensor measures a source pressure of air from the air source. A controller receives signal inputs of measured pressure from the first and second pressure sensors and discharges a voltage signal output for actuating the dispensing solenoid valve to supply a positive air pressure from the air source to the syringe in order to discharge the liquid from the syringe. An air suction device provides negative air pressure to the syringe for preventing the liquid from dripping from the syringe after completion of the dispensing operation.

The controller typically controls the duration of the output voltage signal until the syringe pressure reaches a preset value depending on the amount of liquid remaining in the syringe. Variation in the syringe pressure due to the amount of liquid remaining in the syringe is estimated by the controller to keep the amount of liquid dispensed constant regardless of the amount of liquid remaining in the syringe. Hence, the apparatus is controlled to dispense liquid from the syringe until the air pressure in the syringe reaches the preset pressure. However, accurate dispensing of the liquid may not be possible when the air pressure does not reach the preset pressure at the correct time due to change or variation of the syringe inner volume, conduit inner diameter or compressed pressure.

U.S. Pat. No. 5,277,333 entitled "Apparatus for Metering and Discharging a Liquid" discloses a liquid dispenser capable of dispensing a constant amount of liquid in spite of variations of air pressure in a syringe. The dispenser consists of two pressure sensors, three valves and corresponding pneumatic and electronic circuits. A first pressure sensor detects and measures source pressure from an air source while a second pressure sensor detects and measures syringe pressure. A first valve switchably connects pressurized air from the air source to the syringe to dispense liquid, or releases pressure from the syringe to stop dispensing. A second valve switchably connects the syringe to a vacuum source and a third valve switchably connects the syringe to an exhaust vent. A controller generates a shifting output signal for a certain duration corresponding to a quantity of liquid remaining in the syringe so as to accurately dispense the liquid from the syringe.

However, there are disadvantages in the design of this liquid dispenser. Since the first valve either connects the syringe to receive pressurized air or to release air, pressurization and release of air cannot be conducted simultaneously. This slows down liquid dispensation and more importantly, does not provide real time control of the syringe pressure which may reduce the accuracy of the syringe pressure measured. The accuracy of the determined dispensing time may also be affected. It is therefore desirable to regulate the pressure more effectively so as to be able to dispense a more precise amount of liquid. Furthermore, only two pneumatic pressures can be measured, namely the source pressure and the syringe pressure. Measuring more than just the two pneumatic pressures would be beneficial to improve general dispensing performance. Moreover, adjustment of the pressure of the pressurization air source is done manually off-line. This gives rise to idle time and lengthens the operation time.

SUMMARY OF THE INVENTION

It is thus an object of this invention to seek to provide a liquid dispenser having improved control of the syringe pressure for dispensing operations and enhanced ability to accurately detect pressure along multiple pneumatic paths in the dispenser for dispensing a required quantity of liquid more precisely as compared to the aforesaid prior art.

Accordingly, the invention provides a liquid dispensing apparatus comprising: a syringe for storing and dispensing a liquid and a connector passage connected to the syringe; a positive pressure passage which is connected to an air source for supplying positive pressure to the syringe; a pressure valve located along the positive pressure passage that is operative to control the flow of air along the positive pressure passage; a vacuum passage which is connected to a vacuum generator for supplying vacuum pressure to the syringe; a vacuum valve located along the vacuum passage that is operative to control the flow of air along the vacuum passage; and a pressure sensor which is operative to measure the pressure in the connector passage; wherein the positive pressure passage and vacuum passage are connected to the connector passage.

It would be convenient hereinafter to describe the invention in greater detail by reference to the accompanying drawing which illustrates the preferred embodiment of the invention. The particularity of the drawing and the related description is not to be understood as superseding the generality of the broad identification of the invention as defined by the claims.

BRIEF DESCRIPTION OF THE DRAWING

The present invention will be readily appreciated by reference to the detailed description of the preferred embodiment of the invention when considered with the accompanying drawing, in which:

FIG. 1 is a schematic system diagram of a liquid dispensing apparatus according to the preferred embodiment of the present invention.

DETAILED DESCRIPTION OF THE PREFERRED EMBODIMENT OF THE INVENTION

FIG. 1 is a schematic system diagram of a liquid dispensing apparatus 10 according to the preferred embodiment of the present invention. A syringe 11 for storing and dispensing a liquid is connected with a connector passage which comprises first and second conduits 14, 16. A dispensing valve 12 is located along the connector passage and is connected to the syringe 11 by the first conduit 14. The dispensing valve 12 is operative to control the flow of air along the first and second conduits 14, 16. The second conduit 16 connects the dispensing valve 12 and the syringe 11 to an interlinking joint 17.

A pressure sensor 20 is operative to measure the pressure in the second conduit 16 of the connector passage. The pressure sensor 20 may be connected to the second conduit 16 by a pressure sensor conduit 22, which is interposed between the dispensing valve 12 and the interlinking joint 17 to sense the pressure in the second conduit 16.

A positive pressure passage, comprising a third conduit 23, a fourth conduit 24, a fifth conduit 28 and a sixth conduit 30, is fluidly connected to an air source 34 for supplying positive pressure to the syringe 11. A pressure valve 18 located along the positive pressure passage is operative to control the flow of air along the positive pressure passage. Via the interlinking joint 17, the dispensing valve 12 is connected to the pressure valve 18 by the third conduit 23.

A pressure tank 26, which is located between the pressure valve 18 and the air source 34, is connected to the pressure valve 18 by the fourth conduit 24 and is further connected to the air source 34 via a pressure regulator 32 by the fifth conduit 28 and the sixth conduit 30. The pressure regulator 32 which is therefore located between the air source 34 and the pressure valve 18 automatically regulates the positive pressure supplied to the syringe 11 from the air source 34.

A vacuum passage, comprising a seventh conduit 36, an eighth conduit 44 and a ninth conduit 46, is connected to a vacuum generator 48 for supplying vacuum pressure to the syringe 11. A vacuum valve 40 located along the vacuum passage is operative to control the flow of air along the vacuum passage. Via the interlinking joint 17, the dispensing valve 12 is connected to the vacuum valve 40 by the seventh conduit 36.

The seventh conduit 36 connects the vacuum valve 40 to the interlinking joint 17, and the eighth conduit 44 connects the vacuum valve 40 to a vacuum tank 42. The vacuum tank 42 is located between the vacuum valve 40 and the vacuum generator 48. Both the pressure tank 26 and the vacuum tank 42 function to generate uniform pressure in the respective third and seventh conduits 23, 36, that is, in the respective positive pressure passage and vacuum passage quickly. The vacuum tank 42 is connected to the vacuum generator 48 by the ninth conduit 46. The vacuum generator 48 is further connected to the pressure regulator 32 by the sixth conduit 30, to which the fifth conduit 28 linked to the pressure tank 26 is also connected.

An exhaust passage, comprising a tenth conduit 37 and an eleventh conduit 41, is connected to an exhaust 39 for expelling excess air from the connector passage and the conduits of the liquid dispensing apparatus 10. An exhaust valve 38 located along the exhaust passage is operative to control the flow of air along the exhaust passage. Via the interlinking joint 17, the dispensing valve 12 is connected to the exhaust valve 38 by the tenth conduit 37.

All the valves 12, 18, 38, 40 may comprise position type valves. The positive air pressure passage, vacuum passage and exhaust passage are all connected to the connector passage at the interlinking joint 17, although they may alternatively also be connected to the connector passage at different points along the connector passage.

The various passages create several pneumatic paths to the syringe 11 via the interlinking joint 17. More specifically, three different pneumatic paths are linked to the syringe 11 via the interlinking joint 17. The opening or closing of the connecting valves 18, 38, 40 along these three pneumatic paths, as well as the dispensing valve 12, allow the respective pneumatic paths to communicate with the syringe 11 to regulate the syringe pressure in real time during dispensing.

Using the aforesaid set-up, various operation modes may be provided by the liquid dispensing apparatus 10. During a dispensing mode, a predetermined volume of liquid is dispensed from the syringe 11 with compensation for variations in the syringe's liquid level based upon prior calibration, and the air pressure fluctuation in the syringe 11. The pressure valve 18 and dispensing valve 12 are open, while the exhaust valve 38 and the vacuum valve 40 are closed. The dispensing pressure and time are under constant control so that a consistent volume of fluid can be dispensed. A user may set up a dispensing profile having a nominal dispensing time and dispensing pressure, with compensations for actual dispensing. The pressure from the air source 34 can further be automatically regulated by the pressure regulator 32 during dispensing in order to obtain the required dispensing pressure according to the dispensing profile.

In order to stop the liquid dispensing apparatus 10 from dispensing liquid, the dispensing valve 12 and the vacuum valve 40 are opened and the pressure valve 18 is closed. In an anti-dripping mode, the exhaust valve 38 and the vacuum valve 40 are opened substantially simultaneously so that the syringe pressure drops quickly to improve the liquid tail and to stop the dispensation of the liquid. The pressure valve 18 will be closed. Closed-loop vacuum control is provided to balance and compensate for the weight of the liquid. The anti-dripping pressure can also be adjusted by the user by presetting a nominal vacuum value for preventing liquid from dripping after dispensing is stopped. Moreover, the included dispensing valve 12 can be closed thereafter in order to prevent liquid from dripping from the syringe.

An ambient pressure operation mode allows online measurements to be made to determine compensations to maintain a consistent volume of liquid dispensed. The pressure sensor 20 is used to detect the ambient pressure of the dispenser 10. Online measurement of the ambient pressure can be used for resetting the pressure sensor 20, and for calculating dispensing and anti-dripping compensations. Other pressure measurement modes are also possible. For instance, online measurement of the fluctuation of air pressure from the air source 34 helps to regulate the dispensing air pressure to make dispensing volume consistent. Furthermore, online measurement of the vacuum generator 48 pressure enables the liquid dispensing apparatus 10 to automatically adjust the anti-dripping control parameters.

Under a syringe pressure modelling mode, a user may customize time-pressure models for adapting the liquid dispensing apparatus 10 to a particular syringe and tube. Under this mode, time-pressure models may be developed for the syringe 11 under full and empty conditions. The time-pressure models can then be used for estimating the liquid level in the syringe 11 and for adjusting the dispensing time accordingly during dispensing operations. From the model, the liquid level can then be estimated based upon pressure measurements from the pressure sensor 20, and the user may be warned when the syringe 11 is empty. Additionally, the liquid dispensing apparatus 10 can also function in a manual mode to allow the user to operate the valves individually during manual operation.

The liquid dispensing apparatus 10 essentially needs only one pressure sensor 20 which suffices to measure pressures in the respective pneumatic paths 16, 23, 36 connecting the air source 34 and the vacuum generator 48 to the syringe 11. The pressure sensor 20 can also measure syringe pressure when the dispensing valve 12 is open.

A controller (not shown) receives the input signal from the dispensing pressure sensor 20 and outputs corresponding voltage signals which control the duration with which to increase or decrease air pressure in the syringe by activating the pressure valve 18 and the vacuum valve 40 accordingly. The exhaust valve 38 which leads to the exhaust 39 may also be activated to release pressure in the liquid dispensing apparatus 10 to regulate the ambient pressure. The pressure valve 18, exhaust valve 38 and the vacuum valve 40 are all connected to the syringe 11 and are arranged in parallel which allow simultaneous valve operations, that is, the timing of the operation of each valve can overlap. The duration of operation of each valve may be controlled by monitoring the pressure in the second conduit 16 with the pressure sensor 20, which makes time sharing feasible. This time sharing operation allows for measurement of the valves' transient properties and for the dispenser 10 to compensate for such transient properties. Therefore, the interconnected paths allow pressurization and release to be conducted simultaneously, and thereby improves real-time control of the syringe 11 through time sharing.

The dispensing valve 12 may further facilitate time sharing operations as the pressure sensor 20 can function during the time when the dispensing valve 12 is closed. While the dispensing valve 12 is closed to prevent liquid dripping when the syringe 11 stops dispensing, the pressure sensor 20 can be connected to other pneumatic paths to measure the respective air pressures. The pressure sensor 20 can either measure pressure in the pressure passage by selectively closing both the exhaust valve 38 and the vacuum valve 40, and opening the pressure valve 18, or measure pressure in the vacuum passage by selectively closing both the pressure valve 18 and the exhaust valve 38 and opening the vacuum valve 40. Further, the pressure sensor 20 can measure pressure in the exhaust passage by selectively closing both the pressure valve 18 and the vacuum valve 38, and opening the exhaust valve 38. The pressure valve 18 and vacuum valve 40 further allow pressurization and release of pressure in the connector passage simultaneously when both valves are open at the same time.

It is further possible to conduct online calibration of the pressure sensor 20 and to reset the reading to zero in case of drifting of the sensor readings and/or ambient pressure drifting, based on the measured ambient pressure. Online compensation due to pressure fluctuation of the air source 34 is also possible from measuring the pressure regulator 32 pressure. Similarly, online compensation of vacuum fluctuation by measuring pressure variations of the vacuum generator 48 can also be done. There can further be an automatic adjustment of pressurization online during dispensing via control with the pressure regulator 32. The pressure regulator 32 controls the air pressure in the positive pressure passage to obtain a constant dispensing time for varying levels of liquid remaining in the syringe 11, by varying the dispensing pressure provided to the syringe 11. This is useful for synchronizing multiple dispensers as well as maintaining a consistent rate of dispensing, thereby maintaining the output productivity regardless of the remaining liquid level in the syringe 11.

It should be appreciated that the parallel arrangement of the pressure valve 18, exhaust valve 38 and the vacuum valve 40 and the location of the pressure sensor 20 between these three valves and the dispensing valve 12 allow simultaneous valve operations and time sharing operations. This permits real time control of the dispensing pressure in the liquid dispensing apparatus 10. The online calibration described above also allows online pressure measurements of the pressure regulator 32, ambient, vacuum generator 48 and syringe 11 pressures, thereby allowing for regulation of the pressure of the manifold comprising the various valves. Accordingly, a consistent dispensing rate is obtainable despite variations in the syringe level and synchronization of multiple dispensers is facilitated. Time sharing operations also permit constant pressure measurement and control, reducing or eliminating idling time of the liquid dispensing apparatus 10.

Furthermore, although only one pressure sensor 20 is used in the liquid dispensing apparatus 10, more pressure measurements are possible than a conventional liquid dispenser which uses two sensors. This is achieved by incorporating four valves in the liquid dispensing apparatus 10 for time sharing operations. Another advantage that the liquid dispensing apparatus 10 exhibits is that it is able to control both the duration of dispensing time and the pressure in the various pneumatic paths whereas conventional liquid dispensers only control dispensing time based upon a largely fixed dispensing pressure.

By making more information available on the pressures existing in the various pneumatic paths, the liquid level in the syringe 11 can be estimated more accurately to enable the liquid dispensing time to be made highly consistent. Hence, a consistent amount of liquid can be dispensed despite variations in the liquid level in the syringe.

The invention described herein is susceptible to variations, modifications and/or additions other than those specifically described and it is to be understood that the invention includes all such variations, modifications and/or additions which fall within the spirit and scope of the above description.

The invention claimed is:

1. Liquid dispensing apparatus comprising:

a syringe for storing and dispensing a liquid and a connector passage connected to the syringe;

a positive pressure passage which is connected to an air source for supplying positive pressure to the syringe;

a pressure valve located along the positive pressure passage, and the pressure valve is operative to control the flow of air along the positive pressure passage;

a vacuum passage which is connected to a vacuum generator for supplying vacuum pressure to the syringe;

a vacuum valve located along the vacuum passage, and the vacuum valve is operative to control the flow of air along the vacuum passage;

and a pressure sensor which is operative to measure the pressure in the connector passage; wherein the positive pressure passage and vacuum passage are connected to the connector passage; and a dispensing valve located along the connector passage, and the dispensing valve is operative to control the flow of air along the connector passage.

2. Liquid dispensing apparatus as claimed in claim 1, wherein the positive pressure passage, vacuum passage and connector passage are all connected at an interlinking joint.

3. Liquid dispensing apparatus as claimed in claim 1, further comprising an exhaust passage which is connected to an exhaust, the exhaust passage being connected to the connector passage for expelling excess air from the connector passage.

4. Liquid dispensing apparatus as claimed in claim 3, further comprising an exhaust valve located along the exhaust passage that is operative to control the flow of air along the exhaust passage.

5. Liquid dispensing apparatus as claimed in claim 4, wherein the pressure sensor is operative to measure pressure in the exhaust passage by opening the exhaust valve and closing the pressure valve, the vacuum valve and the connector passage leading to the syringe.

6. Liquid dispensing apparatus as claimed in claim 3, wherein the positive pressure passage, vacuum passage, exhaust passage and connector passage are all connected at an interlinking joint.

7. Liquid dispensing apparatus as claimed in claim 1, wherein the pressure sensor is connected to the connector passage via a pressure sensor conduit.

8. Liquid dispensing apparatus as claimed in claim 1, further comprising a pressure tank located between the pressure valve and air source for generating uniform pressure in the positive pressure passage quickly.

9. Liquid dispensing apparatus as claimed in claim 1, further comprising a pressure regulator between the air source and the pressure valve for automatically regulating the positive pressure supplied to the syringe from the air source.

10. Liquid dispensing apparatus as claimed in claim 9, wherein the pressure regulator is operative to control the air pressure in the positive pressure passage to obtain a constant dispensing time for varying levels of liquid remaining in the syringe.

11. Liquid dispensing apparatus as claimed in claim 1, further comprising a vacuum tank located between the vacuum valve and the vacuum generator for generating uniform pressure in the vacuum passage quickly.

12. Liquid dispensing apparatus as claimed in claim 1, wherein the pressure and dispensing valves are open and the vacuum valve is closed during dispensing of the liquid.

13. Liquid dispensing apparatus as claimed in claim 1, wherein the dispensing and vacuum valve are opened and the pressure valve is closed to stop dispensing of the liquid.

14. Liquid dispensing apparatus as claimed in claim 1, wherein the dispensing valve is operative to be closed to prevent dripping of liquid from the syringe.

15. Liquid dispensing apparatus as claimed in claim 1, wherein the pressure sensor is operative to measure pressure in the pressure passage by closing the dispensing valve and selectively closing the vacuum valve and opening the pressure valve.

16. Liquid dispensing apparatus as claimed in claim 1, wherein the pressure sensor is operative to measure pressure in the vacuum passage by closing the dispensing valve and selectively closing the pressure valve and opening the vacuum valve.

17. Liquid dispensing apparatus comprising:

a syringe for storing and dispensing a liquid and a connector passage connected to the syringe;

a positive pressure passage which is connected to an air source for supplying positive pressure to the syringe;

a pressure valve located along the positive pressure passage, and the pressure valve is operative to control the flow of air along the positive pressure passage;

a vacuum passage which is connected to a vacuum generator for supplying vacuum pressure to the syringe;

a vacuum valve located along the vacuum passage, and the vacuum valve is operative to control the flow of air along the vacuum passage;

a pressure sensor which is operative to measure the pressure in the connector passage; wherein the positive pressure passage and vacuum passage are connected to the connector passage; and wherein the pressure valve and vacuum valve are operative to allow pressurization and release of pressure in the connector passage simultaneously when the pressure and vacuum valves are open at the same time.

18. Liquid dispensing apparatus as claimed in claim 1, wherein the pressure valve and vacuum valve comprise position type valves.

* * * * *